US008082974B2

(12) United States Patent
Yoshiara et al.

(10) Patent No.: US 8,082,974 B2
(45) Date of Patent: Dec. 27, 2011

(54) METAL MOLD STRUCTURE AND CASTING METHOD

(75) Inventors: Keita Yoshiara, Tochigi (JP); Takashi Ikekita, Tochigi (JP); Atsushi Yamashita, Tochigi (JP); Yoshimichi Oguri, Tochigi (JP)

(73) Assignee: Honda Motor Co., Ltd., Tokyo (JP)

( * ) Notice: Subject to any disclaimer, the term of this patent is extended or adjusted under 35 U.S.C. 154(b) by 0 days.

(21) Appl. No.: 13/025,205

(22) Filed: Feb. 11, 2011

(65) Prior Publication Data

US 2011/0198051 A1 Aug. 18, 2011

(30) Foreign Application Priority Data

Feb. 12, 2010 (JP) ..... 2010-028505

(51) Int. Cl.
*B22D 33/04* (2006.01)
*B41B 11/56* (2006.01)

(52) U.S. Cl. ..... 164/137; 249/118

(58) Field of Classification Search ..... 164/137, 164/30–32, 365–370, 521, 76.1; 249/117, 249/118

See application file for complete search history.

(56) References Cited

FOREIGN PATENT DOCUMENTS

JP 61-095741 5/1986
JP 2007-152382 6/2007

*Primary Examiner* — Jessica L Ward
*Assistant Examiner* — Steven Ha
(74) *Attorney, Agent, or Firm* — Rankin, Hill & Clark LLP

(57) ABSTRACT

Object: To provide a small-sized, durable metal mold structure capable of casting two cylinder blocks at a time.

Solution: A metal mold structure for casting two cylinder blocks W at a time, comprises left and right inner slide cores 5*a*, 5*b* being interposed between two cylinder blocks W, hydraulic cylinder units 10, 11 adapted to move each of these left and right inner slide cores 5*a*, 5*b*, inclined holes 12, 13 being provided in each of the left and right inner slide cores 5*a*, 5*b*, and inclined pins 14, 15 being provided on a fixed mold 2 and inserted into the inclined holes 12, 13 with a predetermined clearance C1, C2 maintained respectively, wherein, when the fixed mold 2 is operated, each of the inclined pins 14, 15 pushes a wall surface of the inclined hole 12, 13 in such a way as to move the left and right inner slide cores 5*a*, 5*b* in a mold opening direction respectively. Preferably, the clearances C1, C2 are different with respect to the left and right inner slide cores 5*a*, 5*b*.

4 Claims, 3 Drawing Sheets

METAL MOLD STRUCTURE AND CASTING METHOD

TECHNICAL FIELD

The present invention relates to a metal mold structure for casting two cylinder blocks at a time and a casting method by this metal mold structure.

BACKGROUND ART

As a metal mold structure for casting two cylinder blocks at a time there is known the structure, as disclosed in patent reference 1, that a slide core provided between the cylinder blocks is operated by an inclined pin provided in a fixed mold. Further, as disclosed in patent reference 2, there is known the structure that a slide core is operated by a cylinder device.

Patent reference 1: Japanese patent laid-open publication No. S61-95741.

Patent reference 2: Japanese patent laid-open publication No. 2007-152382.

DISCLOSURE OF THE INVENTION

Problem to be Solved by the Invention

In the invention disclosed in patent reference 1, however, the inclined pin becomes longer so that there is a possibility of breaking. Moreover, in the invention disclosed in patent reference 2, since the cylinder device is required to have a large driving force against a large mold releasing resistance which is produced in the initial stage of a mold releasing operation, the device may become excessively large.

The present invention is made in view of the above-described problems which are found in the conventional art. The object of the present invention is to provide a small-sized but durable metal mold structure and a casting method which are capable of casting two cylinder blocks at a time.

Means for Solving the Problem

For solving the above described problems, the invention as defined in claim 1 provides a metal mold structure for casting two cylinder blocks at a time, comprising left and right inner slide cores being interposed between two cylinder blocks, driving means adapted to move each of these left and right inner slide cores, inclined holes being provided in each of the left and right inner slide cores, and inclined pins being provided on a fixed mold and inserted into the inclined holes with a predetermined clearance maintained respectively, wherein, when the fixed mold is operated, each of the inclined pins pushes a wall surface of the inclined hole in such a manner as to move the left and right inner slide cores in a mold opening direction respectively.

It is preferable that the clearances between the inclined holes and the inclined pins are different from each other with respect to the left and right inner slide cores.

The invention as defined in claim 3 provides a casting method of casting two cylinder blocks at a time by the metal mold structure according to claim 1, comprising a first step of allowing left and right inner slide cores to be moved in a mold opening direction respectively when a fixed mold is operated and an inclined pin pushes a wall surface of an inclined hole, and a second step of allowing, after finishing the first step, the left and right inner slide cores to be moved in the mold opening direction by driving means respectively.

Further, the invention as defined in claim 4 provides a casting method of casting two cylinder blocks at a time by the metal mold structure according to claim 2, comprising a first step of allowing one of the left and right inner slide cores to be moved in a mold opening direction when a fixed mold is operated and one of inclined pins pushes a wall surface of an inclined hole, and a second step of allowing, after finishing the first step, the other of the left and right inner slide cores to be moved in the mold opening direction when the fixed mold is operated and the other of the inclined pins pushes a wall surface of an inclined hole, and a third step of allowing, after finishing the second step, the left and right inner slide cores to be moved in the mold opening direction by driving means respectively.

Effects of the Invention

According to the invention as defined in claim 1, since each of the inclined pins pushes the wall surface of the inclined hole in the initial stage of a mold releasing operation so as to move the left and right inner slide cores and thereafter the left and right inner slide cores are moved by the driving means, it is not necessary for the driving means to have the huge driving force which is required in the initial stage of the mold releasing operation. Therefore, the driving means can be downsized.

Also, in the case where the clearances between the inclined holes and the inclined pins are different from each other with respect to the left and right inner slide cores, the mold releasing timing at the initial stage can be staggered between the left inner slide core and the right inner slide core, so that the force necessary for operating the fixed mold in the initial stage of the mold releasing operation can be lessened.

According to the invention as defined in claim 3, in the first step, the inclined pins push, in the initial stage of the mold releasing operation, the wall surfaces of the inclined holes so as to move the left and right inside cores, and in the second step, the left and right inner slide cores are moved by the driving means. Therefore, it is not necessary for the driving means to have the huge driving force which is required in the initial stage of the mold releasing operation, so that the driving means can be downsized.

According to the invention as defined in claim 4, the process of operating the fixed mold and of allowing the inclined pins to push the wall surfaces of the inclined holes thereby moving the left and right inner slide cores respectively is divided into the first step of moving one of the inner slide cores and the second step of moving the other of the inner slide cores. Therefore, the force necessary for operating the fixed mold in the initial stage of the mold releasing operation can be lessened.

BEST MODE FOR CARRYING OUT THE INVENTION

Figure 1:
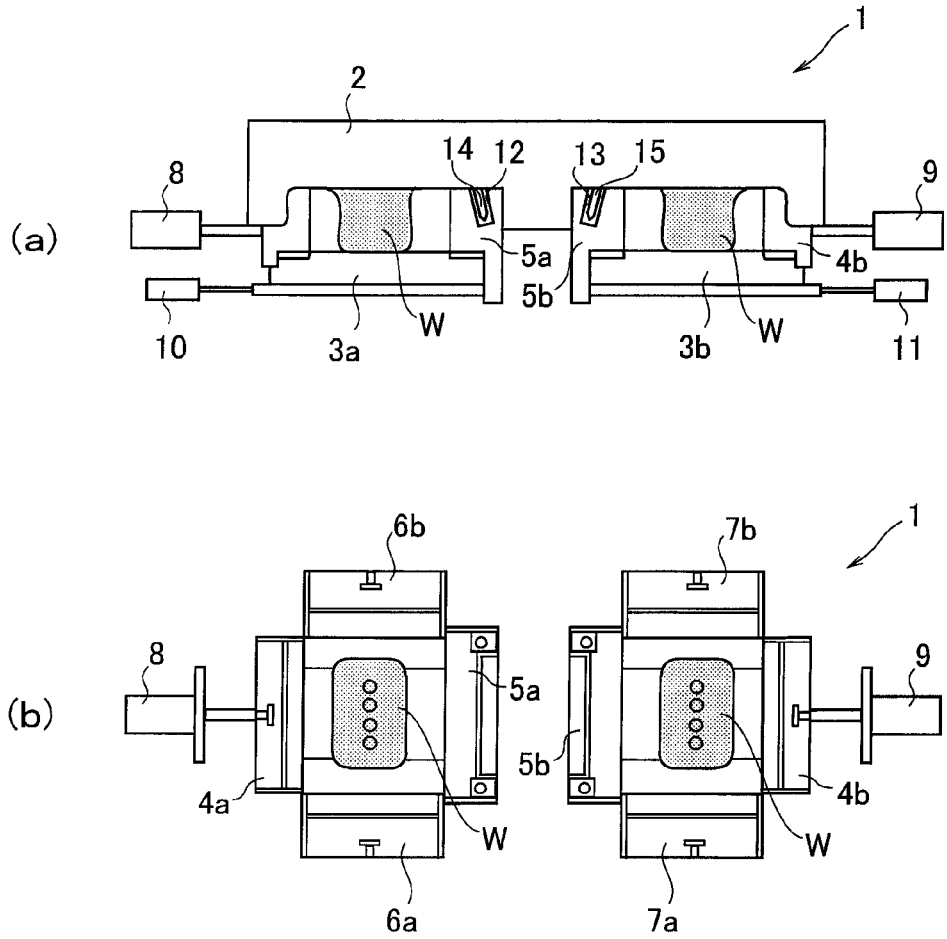
FIG. 1 is a schematic explanatory view of a casting apparatus which is provided with a metal mold structure in accordance with the present invention, wherein (a) shows a side view in a mold closing condition, and (b) is a plan view in the mold closing condition.

Embodiments of the present invention will be described hereunder with reference to the accompanying drawings. A casting apparatus 1 provided with a metal mold structure in accordance with the present invention is configured as an apparatus for casting two cylinder blocks W at a time, as shown in FIG. 1, and comprises an upward and downward movable upper mold (fixed mold) 2, left and right lower molds 3*a*, 3*b* which are arranged in opposition to the upper mold 2, left and right outer slide cores 4*a*, 4*b* which slide leftward and rightward on the lower molds 3*a*, 3*b*, left and right inner slide cores 5*a*, 5*b* which slide leftward and rightward on the lower molds 3*a*, 3*b*, forward and backward slidable side slide cores 6*a*, 6*b* adapted to form a cavity together with the left outer slide core 4*a* and the left inner slide core 5*a*, and forward and backward slidable side slide cores 7*a*, 7*b* adapted to form a cavity together with the right outer slide core 4*b* and the right inner slide core 5*b*.

Further, in the casting apparatus 1, there are provided hydraulic cylinder units 8, 9 adapted to slide the left and right outer slide cores 4*a*, 4*b* and hydraulic cylinder units 10, 11 adapted to slide the left and right inner slide cores 5*a*, 5*b*. Herein, FIG. 1 shows a mold closing condition, wherein in FIG. 1(*a*), the description of the side slide cores 6*a*, 6*b*, 7*a*, 7*b* is omitted, and in FIG. 1(*b*), the description of the upper mold 2 is omitted.

Figure 2:
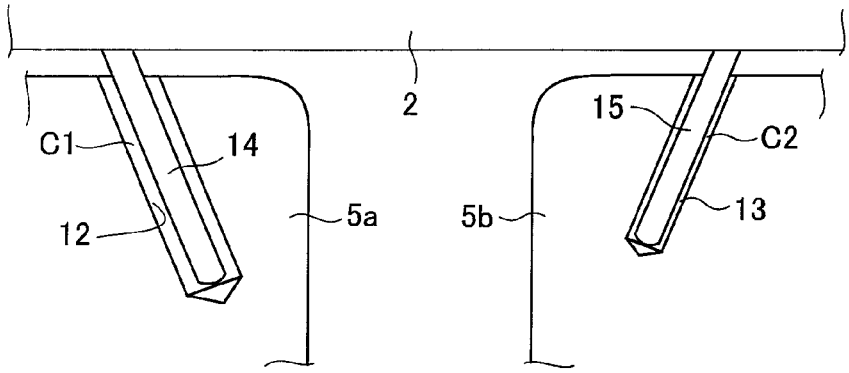
FIG. 2 is an explanatory view showing a relationship between an inclined hole and an inclined pin in the mold closing condition.

Moreover, as shown in FIG. 2, in the upper mold 2 there are provided inclined pins 14, 15 which are configured to be inserted, while maintaining predetermined clearances C1, C2, into inclined holes 12, 13 each provided in the left and right inner slide cores 5*a*, 5*b*. An angle of inclination of the inclined hole 12 is substantially the same as an angle of inclination of the inclined pin 14. Also, an angle of inclination of the inclined hole 13 is substantially the same as an angle of inclination of the inclined pin 15.

Further, the size of the clearance C1 between the inclined hole 12 and the inclined pin 14 provided in the left inner slide core is different from that of the clearance C2 between the inclined hole 13 and the inclined pin 15 provided in the right inner slide core 5*b*. Moreover, the depth of the inclined hole 12 is different from that of the inclined hole 13, while the length of the inclined pin 14 to be inserted into the inclined hole 12 is different from that of the inclined pin 15 to be inserted into the inclined hole 13.

In the embodiments of the present invention, as shown in FIG. 2, the clearance C1 between the inclined hole 12 and the inclined pin 14 is configured to be larger than the clearance C2 between the inclined hole 13 and the inclined pin 15. Also, the depth of the inclined hole 12 is configured to be deeper than that of the inclined hole 13, and the length of the inclined pin 14 is configured to be longer than that of the inclined pin 15.

Accordingly, the size of the clearances C1, C2 between the inclined holes 12, 13 and the inclined pins 14, 15, the depth of the inclined holes 12, 13 and the length of the inclined pins 14, 15 are configured and set as above. Therefore, when the upper mold 2 starts to move upward from the mold closing condition, first the right inner slide core 5*b* is moved a predetermined distance in the mold opening direction by the action of the inclined hole 13 and the inclined pin 15. Next, the left inner slide core 5*a* is moved a predetermined distance in the mold opening direction by the action of the inclined hole 12 and the inclined pin 14.

Then, an amount of movement in the mold opening direction of the left inner slide core 5*a* through the action of the inclined hole 12 and the inclined pin 14 is substantially the same as an amount of movement in the mold opening direction of the right inner slide core 5*b* through the action of the inclined hole 13 and the inclined pin 15.

The operation of the casting apparatus 1 provided with the metal mold structure of the present invention configured as above and the casting method by the use of the metal mold structure will be described hereunder. First, in the mold closing condition as shown in FIG. 3(*a*), the clearance C1 between the inclined hole 12 and the inclined pin 14 is set at a predetermined amount (for example, 5.5 mm), and the clearance C2 between the inclined hole 13 and the inclined pin 15 is set at a predetermined amount (for example, 0.5 mm).

Figure 3:
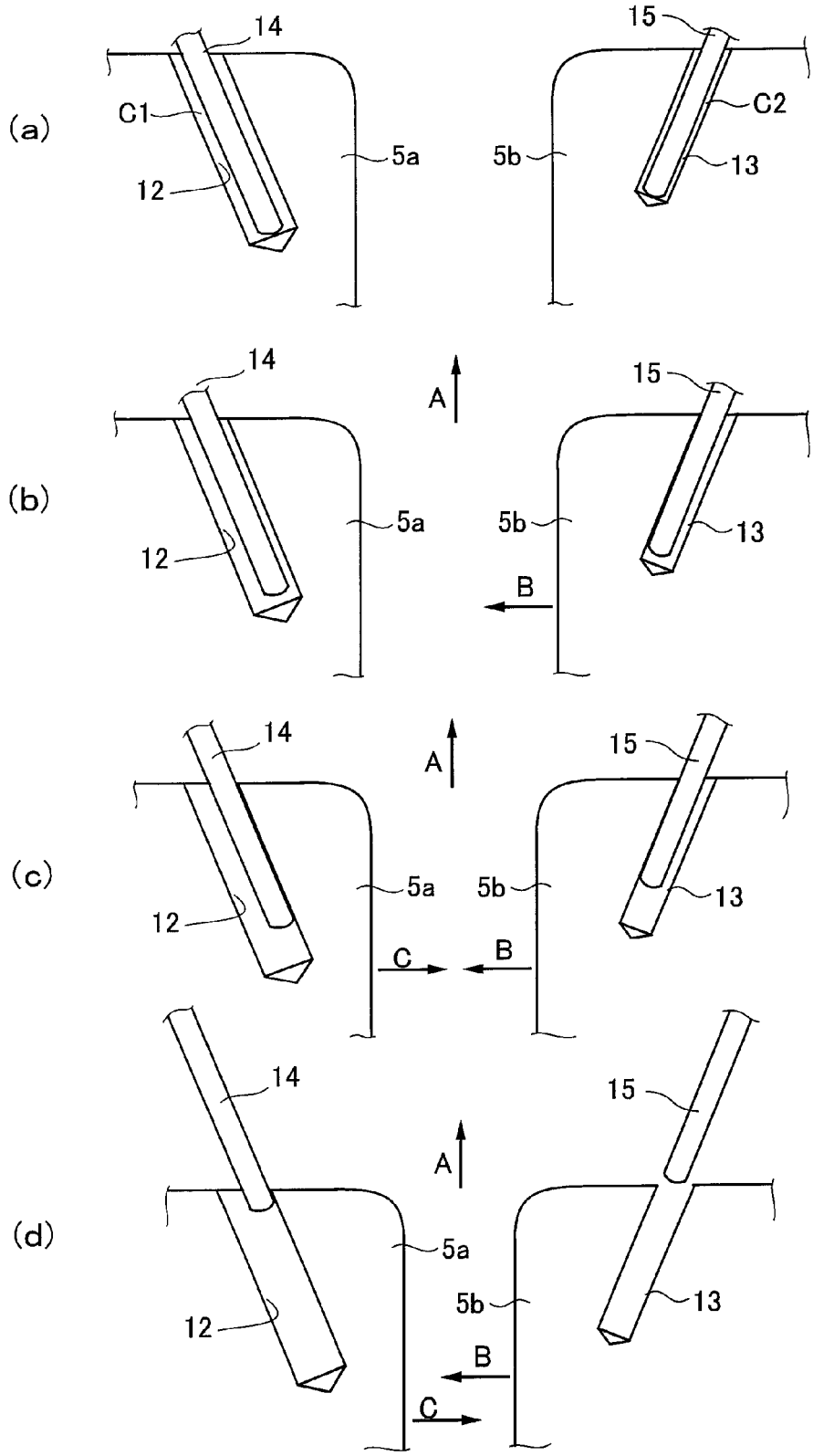
FIG. 3 is an explanatory view of the operation of the metal mold structure in accordance with the present invention, wherein (a) shows a mold closing condition, (b) shows a staring condition of movement with respect to a right inner slide core, (c) shows a starting condition of movement with respect to a left inner slide core, and (d) shows an ending condition of movement by the inclined holes and the inclined pins with respect to the inner slide cores.

Next, when the upper mold 2 starts to move upwards in the direction of an arrow A from the mold closing condition, as shown in FIG. 3(*b*), an outer peripheral surface of the inclined pin 15 comes into contact with the wall surface of the inclined hole 13 and thereafter the outer peripheral surface of the inclined pin 15 starts to slide on the wall surface of the inclined hole 13. Then, when the upper mold 2 moves further upward, the right inner slide core 5*b* is moved (for example, 5 mm) in the mold opening direction (the direction of an arrow B), as shown in FIG. 3(*c*), through the pushing force of the inclined pin 15 against the right inner slide core 5*b*, which acts while the outer peripheral surface of the inclined pin 15 slides on the wall surface of the inclined hole 13 (a first step).

At that time, as shown in FIG. 3(*c*), an outer peripheral surface of the inclined pin 14 also comes into contact with the wall surface of the inclined hole 12 and thereafter the outer peripheral surface of the inclined pin 14 starts to slide on the wall surface of the inclined hole 12. Then, when the upper mold 2 moves further upward, the left inner slide core 5*a* is also moved in the mold opening direction (the direction of an arrow C) through the pushing force of the inclined pin 14 which acts while the outer peripheral surface of the inclined pin 14 slides on the wall surface of the inclined hole 12. Similarly, the right inner slide core 5*b* is also moved in the mold opening direction (the direction of the arrow B) successively through the pushing force of the inclined pin 15 which acts while the outer peripheral surface of the inclined pin 15 slides on the wall surface of the inclined hole 13.

Then, as shown in FIG. 3(*d*), the further upward movement of the upper mold 2 allows the inclined pin 15 to come out of the incline hole 13, whereby the right inner slide core 5*b* stops movement through the pushing force of the inclined pin 15. Consequently, the right inner slide core 5*b* is moved a predetermined amount (for example, 10 mm) from the initial stage of the mold releasing operation.

Further, the left inner slide core 5*a* is also moved through the pushing force of the inclined pin 14 which acts while the outer peripheral surface of the inclined pin 14 slides on the wall surface of the inclined hole 12 until the inclined pin 14 comes out of the inclined hole 12, so that the left inner slide core 5*a* is moved a predetermined amount (for example, 10 mm) from the initial stage of the mold releasing operation (a second step).

Figure 4:
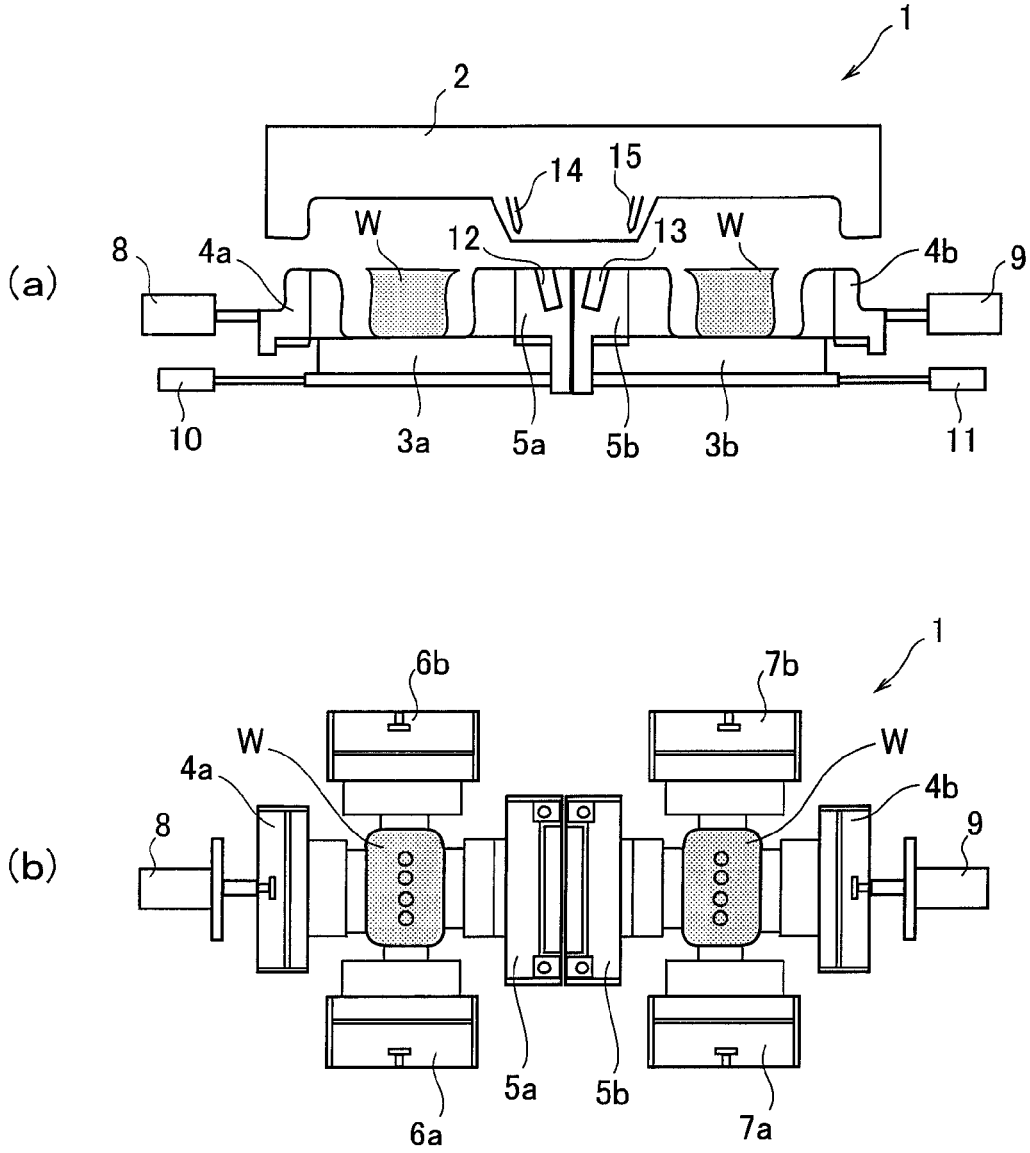
FIG. 4 is a schematic explanatory view of a casting apparatus provided with the metal mold structure in accordance with the present invention, wherein (a) shows a side view in a mold opening condition, and (b) shows a plan view in the mold opening condition.

Then, when the mold releasing operation by the inclined holes 12, 13 and the inclined pins 14, 15 is finished, as shown in FIG. 4, the left and right outer slide cores 4*a*, 4*b* are moved in the mold opening direction by the hydraulic cylinder units 8, 9. Moreover, the left and right inner slide cores 4*a*, 4*b* are moved further in the mold opening direction by the hydraulic cylinder units 10, 11 (a third step). Similarly, the side slide cores 6*a*, 6*b*, 7*a*, 7*b* are moved in the mold opening direction by each of cylinder units (not shown).

As described above, in the initial stage of the mold releasing operation, the inclined pins 14, 15 pushes the wall surfaces of the inclined holes 12, 13 so as to move the left and right inner slide cores 5*a*, 5*b*, and thereafter the hydraulic cylinder units 10, 11 moves the left and right inner slide cores 5*a*, 5*b*. Accordingly, the huge driving force which is necessary in the initial stage of the mold releasing operation is not required for the hydraulic cylinder units 10, 11 so that it is possible to downsize the hydraulic cylinder units 10, 11.

INDUSTRIAL APPLICABILITY

According to the present invention, the force necessary for moving the left and right inner slide cores and the fixed mold in the initial stage of the mold releasing operation can be lessened. Therefore, it is possible to provide the metal mold structure, which contributes to an energy saving, for casting two cylinder blocks at a time, and the casting method using this metal mold structure.

DESCRIPTION OF NUMERALS

1: Casting apparatus, 2: Upper mold (Fixed mold), 3*a*, 3*b*: Lower mold, 4*a*: Left outer slide core, 4*b*: Right outer slide core, 5*a*: Left inner slide core, 5*b*: Right inner slide core, 6*a*, 6*b*, 7*a*, 7*b*: Side slide core, 8, 9, 10, 11: Hydraulic cylinder unit (Driving means), 12, 13: Inclined hole, 14, 15: Inclined pin, C1, C2: Clearance, W: Cylinder block.

The invention claimed is:

1. A metal mold structure for casting two cylinder blocks at a time, comprising left and right inner slide cores being interposed between two cylinder blocks, driving means adapted to move each of these left and right inner slide cores, inclined holes being provided in each of the left and right inner slide cores, and inclined pins being provided on a fixed mold and inserted into the inclined holes with a predetermined clearance maintained respectively, wherein, when the fixed mold is operated, each of the inclined pins pushes a wall surface of the inclined hole to move the left and right inner slide cores in a mold opening direction respectively.

2. A metal mold structure according to claim 1, wherein the clearances between the inclined holes and the inclined pins are different with respect to the left and right inner slide cores.

3. A casting method of casting two cylinder blocks at a time by the metal mold structure according to claim 1, comprising a first step of allowing the left and right inner slide cores to be moved in a mold opening direction respectively when the fixed mold is operated and the inclined pin pushes a wall surface of the inclined hole, and a second step of allowing, after finishing the first step, the left and right inner slide cores to be moved in the mold opening direction by driving means respectively.

4. A casting method of casting two cylinder blocks at a time by the metal mold structure according to claim 2, comprising a first step of allowing one of the left and right inner slide cores to be moved in a mold opening direction when the fixed mold is operated and one of the inclined pins pushes the wall surface of the inclined hole, and a second step of allowing, after finishing the first step, the other of the left and right inner slide cores to be moved in the mold opening direction when the fixed mold is operated and the other of the inclined pins pushes the wall surface of the inclined hole, and a third step of allowing, after finishing the second step, the left and right inner slide cores to be moved in the mold opening direction by driving means respectively.

* * * * *